US005159165A

United States Patent [19]

Kim

[11] Patent Number: 5,159,165

[45] Date of Patent: Oct. 27, 1992

[54] CONTROL CIRCUIT FOR A MICROWAVE OVEN HAVING BARBECUE AND FISH-BROILING OPTIONS

[75] Inventor: Eung K. Kim, Kyungsangnam-Do, Rep. of Korea

[73] Assignee: Goldstar Co., Ltd., Rep. of Korea

[21] Appl. No.: 629,560

[22] Filed: Dec. 18, 1990

[30] Foreign Application Priority Data

Dec. 30, 1989 [KR] Rep. of Korea ..... 21184/1989

[51] Int. Cl.[5] ..... H05B 6/64

[52] U.S. Cl. ..... 219/10.55 B; 219/10.55 C; 219/10.55 D; 219/10.55 R

[58] Field of Search ..... 219/10.55 B, 10.55 E, 219/10.55 D, 10.55 R, 10.55 C, 492, 494, 506

[56] References Cited

U.S. PATENT DOCUMENTS

| | | | |
|---|---|---|---|
| 4,858,095 | 8/1989 | Narita et al. | 219/10.55 B |
| 4,900,885 | 2/1990 | Inumada | 219/10.55 B |
| 4,904,837 | 2/1990 | Low et al. | 219/10.55 B |
| 4,933,527 | 6/1990 | Edamura | 219/10.55 B |
| 4,958,055 | 9/1990 | Shim | 219/10.55 B |

*Primary Examiner*—Bruce A. Reynolds
*Assistant Examiner*—Tu Hoang
*Attorney, Agent, or Firm*—Anthony J. Casella; Gerald E. Hespos

[57] ABSTRACT

The present invention relates to a micro-wave oven having a barbecue function, and more particularly to a heating device capable of not only the barbecuing but also broiling a fish by controlling the motor-driving duration and driving the motor, which is used for rotating a barbecue, with a single relay. The control circuit of the present invention comprises a latch circuit A which latches a voltage selection for a barbecue, a latch circuit B which latches a voltage selection for broiling a fish, a heater driving circuit E which drives a heater H according to outputs of said latch circuits A and B, an oscillation circuit C which controls the motor-driving duration according to an output of said latch circuit B, a controller for a motor-driver F which controls said motor according to an output of said oscillation circuit C, and a motor-driver circuit D which drives said motor according to a control output from said controller for the motor-driver F.

5 Claims, 2 Drawing Sheets

CONTROL CIRCUIT FOR A MICROWAVE OVEN HAVING BARBECUE AND FISH-BROILING OPTIONS

BACKGROUND OF THE INVENTION

The present invention relates to a micro-wave oven having a barbecue function, and more particularly to a heating device capable of not only barbecuing but also broiling a fish by controlling the motor-driving duration and driving the motor, which is used for rotating a barbecue, with a single relay.

In conventional micro-wave ovens, a fish cooking has to be performed by the barbecue function since a fish-broiling function is not provided in the conventional micro-wave oven. However, the barbecue function generates too much heat for cooking the fish, so that over-cooking of the fish resulted. So, the conventional micro-wave oven has a setback of over-cooking the fish.

SUMMARY OF THE INVENTION

It is therefore an object of the present invention to provide a micro-wave oven having not only the barbecue function but also a fish-broiling function by controlling a motor-driving duration and driving the motor, which is used for rotating a barbecue, with a single relay, thereby to avoid the setback of over-cooking the fish.

BRIEF DESCRIPTION OF THE ATTACHED DRAWINGS

For a better understanding of the invention and to show how the same may be carried into effect, reference will now be made, by way of example, to the accompanying diagrammatic drawings, in which:

FIG. 1 shows a circuit diagram of a heating device having barbecue and fish-broiling options for a micro-wave oven according to the present invention; and FIG. 2 shows a waveform plot of the voltage which drives the motor used for rotating the food against time according to the present invention.

DETAILED DESCRIPTION OF THE INVENTION

Figure 1:
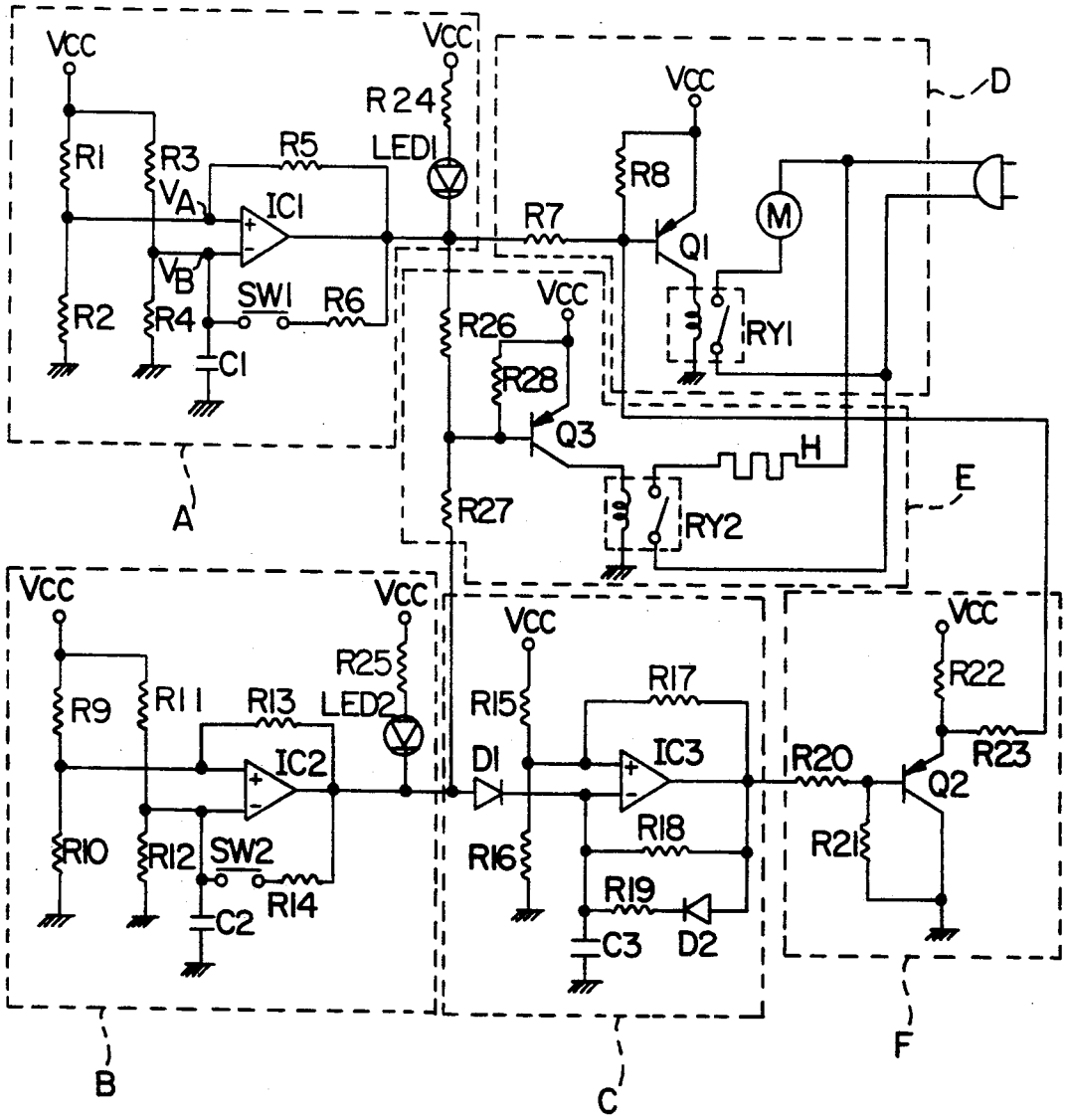

Referring to FIG. 1, a supply voltage Vcc is divided to voltage $V_A$ by resistors R1 and R2 and applied to a non-inverting (+) terminal of a comparator IC1, and a voltage $V_B$, which is resulted in by dividing the supply voltage Vcc by resistors R3 and R4, is applied to an inverting (−) terminal of the comparator IC1.

An output of the comparator IC1 is fedback to its non-inverting (+) terminal through a resistor R5 and is also connected to a barbecue selection switch SW1 through a resistor R6. The other side of the barbecue selection switch SW1 is connected to the inverting (−) terminal of the comparator IC1 and also is grounded through a capacitor C1.

In addition, the output of the comparator IC1 is connected to the supply voltage Vcc through a light emitting diode LED1 and a resistor R24 the light emitting diode LED1 and resistor R24 are connected in series with each other and is the light emitting diode LED1 and resistor R24 are also connected to resistors R7 and R26. The resistor R7 is connected to a resistor R8 and a base of a transistor Q1. The resistor R8 connects to the emitter of the transistor Q1 and both are connected to the supply voltage Vcc.

A collector of the transistor Q1 is grounded through a relay coil RY1. A resistor R23 is connected to the base of transistor Q1 and the emitter of a transistor Q2. The emitter of transistor Q2 is also connected to the supply voltage Vcc through a resistor R22. A collector of the transistor Q2 is grounded, while a resistor R21 connects a base of the transistor Q2 to the collector of transistor Q2. A resistor R20 is connected to an output of a comparator IC3, and the base of transistor Q2. The output of comparator IC3 is also connected to a resistor R17, a resistor R18, and a diode D2. The output of the diode D2 is connected to a capacitor C3 and an inverting (−) terminal of the comparator IC3 through a resistor R19.

The resistor R18 is connected between the inverting (−) terminal of the comparator IC3 and to the input of comparator IC3. The resistor R17 is connected to a non-inverting (+) terminal of the comparator IC3, and to the output of comparator IC3. A voltage which is the result of dividing the supply voltage Vcc with resistors R15 and R16 is applied to the non-inverting (+) terminal of comparator IC3. To the inverting (−) terminal of the comparator IC3, the output of a diode D1 is applied, and the resistor R26 is connected to resistors R27 and R28 and to the base of a transistor Q3.

An emitter of the transistor Q3 is connected to a resistor R28 to make a contact to the voltage supply Vcc, and a collector of the transisitor Q3 is grounded through a relay coil RY2.

A switch reference terminal of the relay RY2 is connected to a switch reference terminal of the relay RY1, and both switch reference terminals RY1, RY2 are connected to the supply voltage Vcc.

A switch connecting terminal of the relay RY2 is connected to the voltage supply through a heater H, and a switch connecting terminal of the relay RY1 is connected to the voltage supply through a motor M. The resistor R27 connects to both an anode of the diode D1 and an output of a comparator IC2.

Also, the output of the comparator IC2 is connected to the supply voltage Vcc through a light emitting diode LED2 and a resistor R25 connected in series with the light emitting diode LED2. To a non-inverting (+) terminal of the comparator IC2, a voltage divided by resistors R9 and R10 is applied, and a node which connects the resistor R9 and resistor R10 is connected to the output of the comparator IC2 through a resistor R13.

To an inverting (−) terminal of the comparator IC2, a voltage which is divided by resistors R11 and R12 is applied, and a node which connects the resistor R11 and the resistor R12 is grounded through a capacitor C2 and is also connected to the output of the comparator IC2 through a fish-broiling selection switch SW2 and a resistor R14 in series.

Here, a circuit A which consists of the resistors R1 through R6, R24, the light emitting diode LED1, the capacitor C1. The switch SW1, and comparator IC1 and a circuit B which consists of the resistors R9 through R14, R25, the switch SW2, the capacitor C2, the light emitting diode LED2, and the comparator IC2 are latch circuits.

A circuit C which consists of the diodes D1 and D2, the resistors R15 through R19, capacitor C3, and the comparator IC3 is an oscillation circuit, and circuit D which consists of the transistor Q1, the resistors R7 and R8, the relay RY1, and the motor M is a motor-driver circuit.

A circuit E which consists of the resistors R26 through R28, the transistor Q3, the relay RY2, and the heater H is a heat driving circuit, and a circuit F which consists of the transistor Q2, the resistors R20 through R23 is a controller circuit for the motor M when the fish-broiling feature is activated.

Turning now more descriptively to the circuit of FIG. 1, the barbecue feature is activated by pressing the barbecue selection switch SW1 as illustrated in FIG. 1, circuit A. In the initial condition immediately after switch SW1 is pressed, voltage Va is greater than voltage Vb, voltage Va is applied to the non-inverting terminal of the voltage comparator IC1, while voltage Vb is applied to the inverting terminal of the voltage comparator IC1. Since the voltage at the non-inverting terminal (Va) is greater than the voltage at the inverting terminal (Vb), the output of the voltage comparator IC1 is logic high. However, when switch SW1 is closed, capacitor C1 begins to charge, storing a voltage Vc, and since capacitor C1 is connected to the inverting terminal of the voltage comparator IC1, voltage Vc is applied to the inverting terminal of the comparator IC1. Since voltage Vc is applied to the inverting terminal of comparator IC1, as capacitor C1 charges, voltage Vc will soon after become greater than Va, therein causing the output of comparator IC1 to become logic low, since the voltage at the inverting terminal (Vc) is greater than the voltage at the non-inverting terminal (Va).

When the comparator IC1 is logic low, diode LED1 turns on and illuminates. The voltage supply Vcc causes diode LED1 to turn on when the output of comparator IC1 is logic low. Subsequently, transistor Q1 is turned on when the output of comparator IC1 is logic low. When transistor Q1 is turned on, the relay RY1 is activated and the motor M is driven. In addition, when transistor Q1 is turned on, transistor Q3 will also be turned on. This is so because the bases of transistors Q1 and Q3 are both connected to the output of comparator IC1. When transistor Q3 is turned on, the relay RY2 is activated causing the heater H to turn on, wherein the heater H generates a sufficient amount of heat required to cook food.

In summary, the barbecue feature is activated by pressing the barbecue selection switch SW1, causing latch circuit A to generate a logic low signal. A logic low signal of latch circuit A subsequently turns on transistors Q1 and Q3, therein turning on both the motor M which is used to rotate the food and the heater H which is used to cook the food.

The fish-broiling feature is activated by pressing the fish-broiling selection switch SW2 as illustrated in FIG. 1, circuit B. Latch circuit B uses the identical operating principle as latch circuit A. Hence, when switch SW2 is pressed, latch circuit B generates a logic low signal.

However, when a fish is being broiled, it is not possible to broil a fish by driving the motor continuously as with the barbecue feature, rather it is necessary to broil one side of the fish for a given time and then to cook the opposite side for a given time by rotating the fish with the motor M. Thus, the time which the motor M is to be driven must be at proscribed intervals.

Accordingly, when the fish-broiling selection switch SW2 is turned on, the output of the voltage comparator IC2 in the latch circuit B becomes logic low and the light emitting diode LED2 turns on. The logic low signal of latch circuit B turns on transistor Q3, which in turn activates the relay RY2, therein activating the heater H. But since it is necessary to control the motor driving duration for motor M, an oscillation circuit must be operated for motor M.

An oscillating circuit C is used to generate discrete switching signals which activates transistor Q2 of the relay driving circuit F, therein activating the motor M. The oscillating circuit C functions such that the output of voltage comparator IC3 is connected to the base of transistor Q2. Transistor Q2 is connected to and activates transistor Q1 which in turn activates the motor M. When voltage comparator IC3 is logic high, transistor Q2 is off, causing transistor Q1 to be off, which in turn causes the motor M to be off. When voltage comparator IC3 is logic low, transistor Q2 is on, transistor Q1 turns on, subsequently causing the motor M to be on. The oscillating circuit functions such that the supply voltage Vcc is divided by resistors R15 and R16 and applied to the non-inverting terminal of the voltage comparator IC3. Connected to the inverting terminal of voltage comparator IC3 is the output of voltage comparator IC2. Thus, when SW2 is pressed, voltage comparator IC2 outputs a logic low signal causing the voltage at the inverting terminal of voltage comparator IC3 to be lower than the voltage at the non-inverting terminal causing voltage comparator IC3 to output a logic high signal.

A logic high signal, as set forth above, turns off the motor M. However, when the capacitor C3 is completely charged, the voltage of the non-inverting terminal becomes lower than the voltage of the inverting terminal, since capacitor C3 is connected to the inverting terminal of voltage comparator IC3. Therefore, since the inverting terminal voltage of voltage comparator IC3 is greater than the non-inverting terminal voltage of voltage comparator IC3, voltage comparator IC3 consequently outputs a logic low signal, and as set forth above, a logic low signal from voltage comparator IC3 turns on the motor M.

Figure 2:
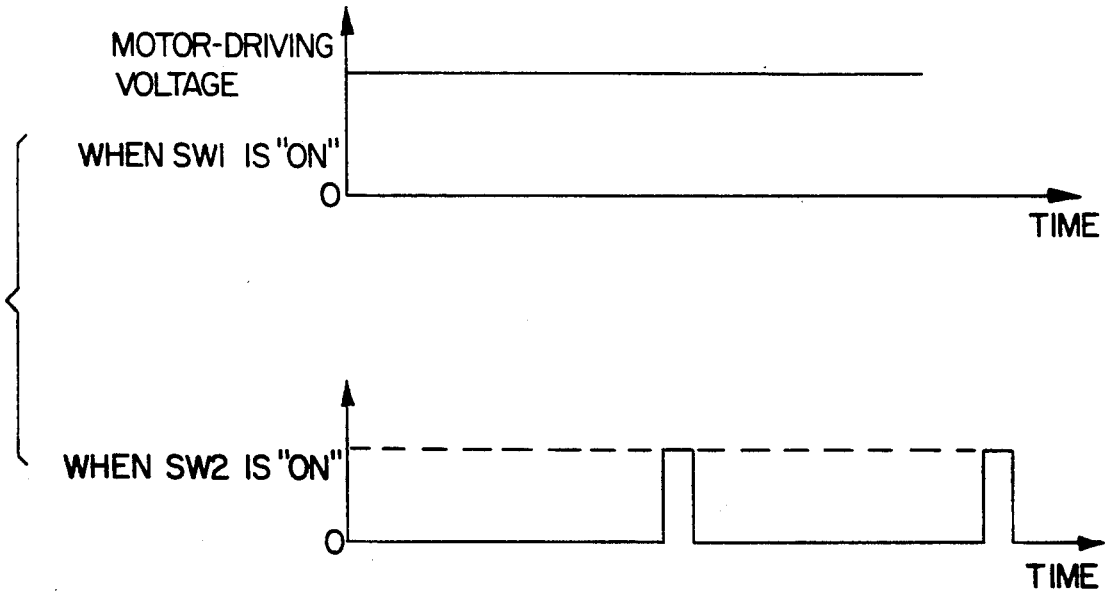

Hence, when capacitor C3 is charged, the motor M is on, when capacitor C3 is discharged, the motor M is off. Accordingly, the time when the motor is turned on and off is determined by the time required for the capacitor C3 to charge and discharge. The time constant of capacitor C3 is determined by the values of capacitor C3, resistor R19 and diode D2. Thus, the oscillating circuit generates discrete switching signals according to capacitor C3, time constant. The time constant of capacitor C3 is determined by the values of components, resistor R19, capacitor C3 and diode D2. As shown in FIG. 2, the discrete switching signal of the oscillating circuit C generates a pulse having a delay of a predetermined time or interval which is used to control the driving duration of the motor M. Therefore, on/off times of the motor M can be controlled by adjusting the values capacitor C3, resistor R19 and diode D2.

What is claimed is:

1. A control circuit for a microwave oven having barbecue and fish-broiling functions comprising a first and second latch circuits, a motor driven circuit, a heat driving circuit, an oscillating circuit, and a controller circuit wherein, said first latch circuit triggers the barbecue function for providing a first logic low signal to activate said motor driven circuit to continuously driving a motor for rotating foods and to activate said heat driving circuit to provide heat for continuously cooking foods;

said second latch circuit triggers the fish-broiling function for providing a second logic low signal to said oscillating circuit, said oscillating circuit generates discrete driving signals which are fed to said controller circuit for causing said motor driven circuit to drive said motor for rotating foods at discrete intervals of time and for causing said heat driving circuit to provide heat for continuously cooking foods;

said controller circuit activates said motor driven circuit for driving said motor in accordance with said signal from a selected one of said first and second latch circuits.

2. A control circuit for a micro-wave oven having barbecue and fish-broiling functions as in claim 1, wherein said first latch circuit comprises;

a first voltage comparator having an output terminal, a non-inverting input terminal and an inverting input terminal;

a plurality of resistors which determine voltages for said inverting and non-inverting input terminals of said first voltage comparator;

a plurality of resistors which feedback an output signal of said first voltage comparator to said inverting and non-inverting input terminals of said first voltage comparator;

a barbecue selection switch which connects to said inverting input terminal of said first voltage comparator;

a first capacitor which is connected to said inverting input terminal of said first voltage comparator; and a first light emitting diode which displays a barbecue cooking option according to an output signal from said first voltage comparator.

3. A control circuit for a micro-wave oven having barbecue and fish-broiling functions as in claim 1, wherein said second latch circuit comprises;

a second voltage comparator having an output terminal, a non-inverting input terminals and an inverting input terminal;

a plurality of resistors which determine voltages for said inverting and non-inverting input terminals of said second voltage comparator;

a plurality of resistors which feedback an output signal of said second voltage comparator to said inverting and non-inverting input terminals of said second voltage comparator;

a fish-broiling selection switch which connects to said inverting input terminal of said second voltage comparator;

a second capacitor which is connected to said inverting input terminal of said second voltage comparator; and a second light emitting diode which displays a fish-broiling cooking option according to an output signal from said second voltage comparator.

4. A control circuit for a micro-wave oven having barbecue and fish-broiling functions as in claim 1, wherein said oscillation circuit comprises:

a third voltage comparator having an output terminal, a non-inverting input terminal and an inverting input terminal wherein said third voltage comparator compares an output voltage signal from said second latch circuit connected to said inverting input terminal with a reference voltage determined by a plurality of resistors connected to said non-inverting input terminal of said third voltage comparator;

a plurality of resistors which feedback the output signal of said third voltage comparator to said inverting and non-inverting input terminals of said third voltage comparator;

at least one resistor connected in series with a second diode whereby the output of said third comparator is feedback to said inverting input terminal resistor connected in series with a second diode; and a capacitor connected to said inverting input terminal of said third voltage comparator when said capacitor is charged, said output signal from said third voltage comparator is logic low and when said capacitor is discharged, said output signal from said third voltage comparator is logic high, wherein when the capacitance of said capacitor is altered, a period of time required for the capacitor to charge and discharge is altered which consequently causes a time period between a logic low and logic high voltage signal from said output terminal of said third voltage comparator to be similarly altered thereby providing the means for said oscillation circuit to oscillated between a logic high and logic low voltage signal.

5. A control circuit for a micro-wave oven having barbecue and fish-broiling option as in claim 1 wherein; said first latch circuit is connected to both said motor driven circuit and heating driving circuit whereby when said output of said first latch circuit is logic low, both said motor driven circuit and heating driving circuit operate continuously;

said second latch circuit is connected to both said oscillating circuit and said heat driving circuit, wherein said oscillating circuit is connected to said motor driven circuit whereby a logic low output signal from said second latch circuit causes the heat driving circuit to operate continuously while causing the oscillating circuit to output a signal which oscillates between a logic low signal and a logic high signal therein causing the motor driven circuit to turn on when the output signal of the oscillating circuit is logic low and turn off when the output signal from the oscillating circuit is logic high.

* * * * *